US007887391B2

(12) United States Patent
Sando

(10) Patent No.: US 7,887,391 B2
(45) Date of Patent: Feb. 15, 2011

(54) APPARATUS FOR POLISHING MEDIA DISCS

(76) Inventor: Richard Francis Sando, 2936 Normandy Dr., Philadelphia, PA (US) 19154

( * ) Notice: Subject to any disclaimer, the term of this patent is extended or adjusted under 35 U.S.C. 154(b) by 0 days.

(21) Appl. No.: 11/967,233

(22) Filed: Dec. 30, 2007

(65) Prior Publication Data

US 2009/0170404 A1 Jul. 2, 2009

(51) Int. Cl.
*B24B 49/00* (2006.01)
*B24B 51/00* (2006.01)

(52) U.S. Cl. ..... 451/5; 451/11; 451/288; 451/290

(58) Field of Classification Search ..... 451/5, 451/11, 36, 41, 59, 63, 285, 288, 290
See application file for complete search history.

(56) References Cited

U.S. PATENT DOCUMENTS 4,179,852 A * 12/1979 Barnett ..... 451/63
4,825,596 A * 5/1989 Kinner ..... 451/14
5,035,087 A * 7/1991 Nishiguchi et al. ..... 451/14
5,207,759 A * 5/1993 Mehmandoust et al. ..... 451/63
5,733,179 A * 3/1998 Bauer ..... 451/41
5,938,510 A * 8/1999 Takahashi et al. ..... 451/290
6,261,159 B1 * 7/2001 Krieg et al. ..... 451/63
6,386,946 B1 * 5/2002 Lin et al. ..... 451/7
6,594,848 B1 * 7/2003 Lee ..... 15/102
6,609,959 B2 * 8/2003 Takahashi et al. ..... 451/65
6,752,694 B2 * 6/2004 Schneegans et al. ..... 451/8
6,802,760 B1 * 10/2004 Goldstein ..... 451/5
7,357,696 B2 * 4/2008 Cooper et al. ..... 451/57
2007/0072523 A1 * 3/2007 Miyahara et al. ..... 451/290

* cited by examiner

*Primary Examiner*—Timothy V Eley
(74) *Attorney, Agent, or Firm*—Rudoler & DeRosa LLC

(57) ABSTRACT

Disclosed is an apparatus for polishing media discs by removing or reducing scratches or substances from the surface of damaged discs, including computer data CDs, DVDs, gaming discs and other media discs. The apparatus enables removal or reduction of scratches and materials that prevent the information or data contained on the disc from being read by a conventional disc reading device. The polishing pressure and time are uniformly controlled at predetermined and precision levels sufficient to remove or reduce scratches from the surface of the disc. Also disclosed is a method of removing or reducing scratches from the surface of media discs by using the apparatus of the present invention. The method can be repeated as many times as necessary or desired in order to obtain a finely polished disc from which data is obtainable by conventional disc reading devices.

8 Claims, 6 Drawing Sheets

APPARATUS FOR POLISHING MEDIA DISCS

BACKGROUND OF THE INVENTION

1. Field of the Invention

The invention relates generally to a field of devices for polishing, buffing or sanding media discs, and in particular to an apparatus for reducing or removing scratches or substances from the surface of media discs using controlled parameters.

2. Description of the Related Art

Media discs like compact discs and video discs have been used for many years to store various forms of information, such as music, videos, pictures, games and data. Many computers, home entertainment systems, computer gaming apparatus and other data processing equipment have the ability to or depend on optical data storage discs to store programmed data and other electronic file information. Information is typically imbedded or imprinted on the optical surface of the disc and is read from the surface of the disc with laser means or other types of optical reading device.

While such discs are readily available and generally reliable, often a disc is handled or used in a way that causes scratches to be created unintentionally on the surface of the disc or an undesired substance to adhere to the surface of the disc, which cannot be easily removed. As such, the disc becomes unreadable by the reading device and the user is unable to retrieve the information stored on the disc. For the most part, the disc becomes unusable. With the present invention, the information on a disc damaged by surface scratches or surface materials can be recovered by polishing the surface of the disc, thus removing the scratches or materials in a quick and effective manner, thereby allowing an unimpeded path by the reading device to the data.

Disc polishing devices currently available on the market that are utilized by companies attempting to recover optical discs do not provide for controlled and uniform pressure application. Current methods for polishing discs are slow and require a great deal of human operator input to make sure that polishing pressure is uniformly applied. Special care must be taken by the operator to ensure that the pressure during polishing is not applied excessively causing removal or damage to the information imprinted on the surface of the disc. If polishing pressure is not uniform or if the disc is polished with too much pressure, the information stored upon the disc may be erased and the disc ruined.

The present invention allows a disc to be polished in such a way as to return the disc to its optimal functionality. This is accomplished with uniform application of the appropriate amount of pressure, uniformly applied across the surface of the disc in order to remove only the slightest amount of surface material on the disc and to bring the disc surface back to a smooth and precise finish in order for the information imprinted on the surface of the disc to be readable by a disc reading device.

Discs are often of significant value well worth the expense and time for an owner to have a disc polished in an attempt to recover the stored information, which would otherwise potentially be lost. A need exists for a large scale operation of the much needed service to the general public. The apparatus and method of the present invention allow multiple discs to be polished simultaneously thus increasing efficiency and productivity of the disc polishing process.

SUMMARY OF THE INVENTION

The present invention relates to a disc polishing apparatus (or device) for polishing the upwardly facing surface of a media disc to reduce/eliminate scratches/substances from the surface of a media disc. The apparatus includes a base (member) comprising at least one rotatable disc platform and a support extending from the base. The rotatable disc platform is located on the base and has a center and an outside edge. The disc platform also has an upwardly facing surface for holding a media disc to be polished and an upwardly protruding pin in the center for centrally positioning the media disc on the upward facing surface of the disc platform. The apparatus also includes a polisher (or polishing member) connected to the support. The polisher is positioned at least partially above the disc platform. The polisher also has a rotatable polishing head facing downwardly toward said upwardly facing surface of the disc platform and a polishing pad. The polishing pad is fabricated from an abrasive material and is carried by the polishing head. The polisher also includes an axial drive for advancing the polishing head from an upper position in which the polishing pad is above and out of contact with the upwardly facing surface of the media disc along an axis perpendicular to the upward facing surface of the disc platform to a lower position in which the polishing head is in contact with the media disc located on the upwardly facing surface of the disc platform. The polisher may further include a controller for automatically regulating the pressure that the polishing head applies to the media disc located on the upward facing surface of the disc platform. The axial drive may include a counter-pressure spring for limiting the amount of pressure that the polishing head applies to the media disc. The pressure regulating controller may include a pneumatic circuit board. The disc polishing apparatus may further include a means for placing said media disc onto the disc platform. The rotatable disc platform may include a centrally located cylindrical pin for centrally positioning the media disc on the platform and grooves extending radially from the center of the disc platform to the outside edge of the disc platform for providing a cushion of air. A timer may be included for controlling the operational time of the polishing head. The rotatable disc platform may include a plurality of disc platforms such that the polishing head is in contact with the upwardly facing surface of the media discs in at least two of the rotatable disc platforms when the polishing head is in the lower position.

The present invention also relates to a method for reducing or eliminating scratches or substances from the surface of media disc. The method includes the steps of: placing a media disc onto the upward facing surface of the disc platform of the disc polishing apparatus, operating the rotating polishing head of the polishing apparatus to advance and contact with the surface of the media disc at a controlled pressure and time, providing a polishing agent onto the surface of the media disc, and retracting the polishing head to end contact between the polishing head and the media disc. The polishing agent may include from 2% to 10% aluminum silicate dust powder. The polishing head rotating step and the polishing agent application step may be repeated to optimize the reduction or removal of the scratches or substances from the surface of the media disc.

Skilled artisans will appreciate that the elements in the diagrams are illustrated for simplicity and clarity to help improve the embodiments of the present invention and have not been drawn to scale.

DETAILED DESCRIPTION OF THE INVENTION

The invention will now be described in detail. In the context of this invention, a number of terms will be utilized. As used herein, the term "disc" refers to any of several types of media, consisting of thin, round plates of plastic, metal or combinations thereof, used for storage of information, including, but not limited to, floppy discs, optical discs, compact discs, magnetic discs, audio compact discs, recordable discs, re-recordable discs, digital video discs, digital versatile discs, DVD video discs, laser discs, mini-discs, video game console discs, including, but not limited to, Sony Play Station® discs, X-Box® 360 discs, and Nintendo GameCube® discs, personal computer (PC) discs, CD-ROM, CD-I, CD-Photo, CD-R, CD-RW, DVD-R, DVD-RW, DVD+R, DVD+RW discs, Sony Blu-ray™ discs, and any and all other similar discs as will be apparently known to those skilled in the art. As used herein, the term disc is interchangeable with the common term "disk" as it is widely and commonly used.

As used herein, the term "polish" or "polishing" means to make smooth and glossy by causing friction and thereby eliminating or reducing scratches, blemishes, cuts or other marks within the surface of the disc and by removing substances or materials that may have accumulated upon the surface of the disc. The term "polishing" includes buffing, sanding, rubbing, and other commonly known terms and known to those skilled in the art.

Figure 1:
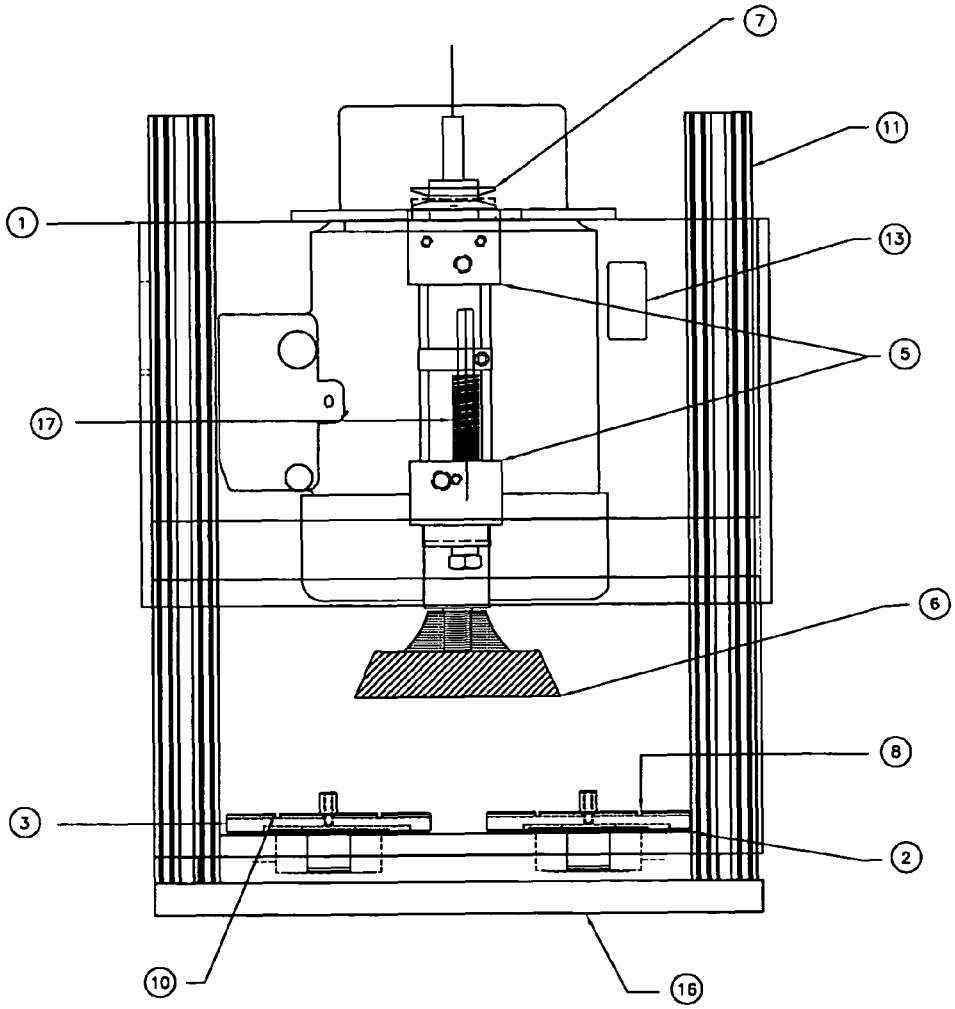
FIG. 1 is a diagram of the frontal view of a preferred embodiment of the apparatus of the present invention.

The invention will be more fully understood with reference to the drawings and the following description. Referring to FIG. 1, the drawing illustrates one embodiment of the media disc polishing apparatus of the present invention (1). The apparatus of the present invention (1) has a base member (2) that is connected to a polishing member (5). At least one rotatable disc platform (3) is fixedly connected to the base member (2). The base member can have any adjustments, such as leveling feet, which allow the apparatus to be adjusted to different operating environments so as to assure a stability of the apparatus during operation. A stable non-vibrating surface is desired to obtain precision and optimal results during the polishing process.

The disc platform (3) is a flat plate, platen or surface and it is desirable that the disc platform (3) be substantially the same circumferential size as the media disc, though the disc platform can be circumferentially larger than the disc.

Figure 2:
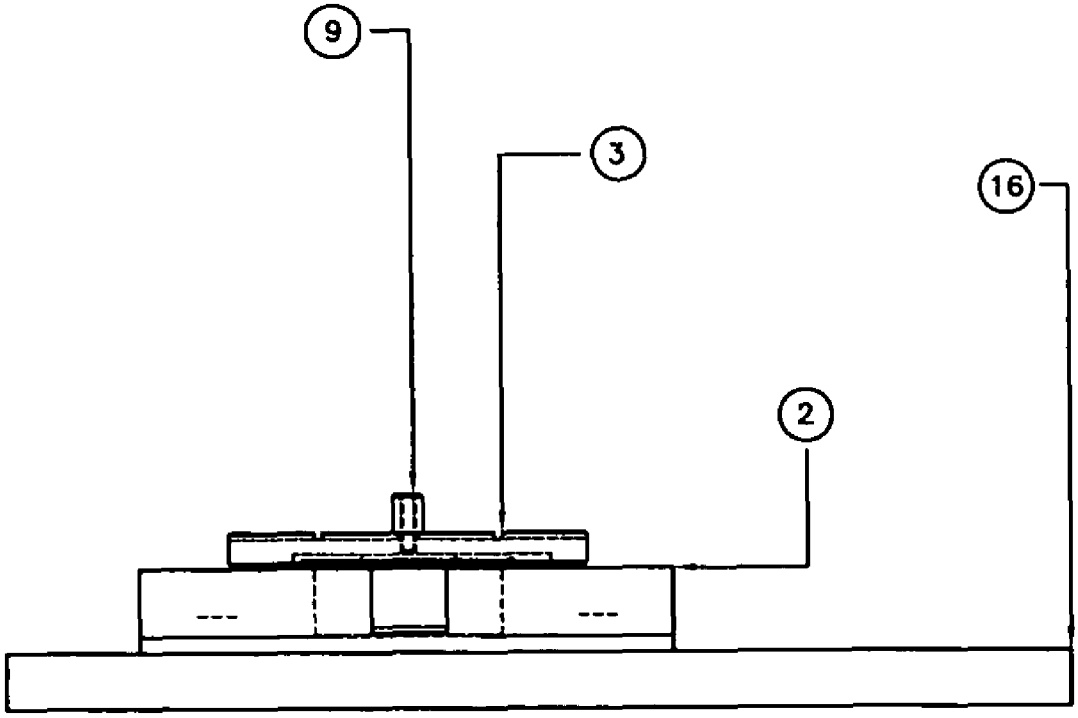
FIG. 2 is a diagram of the side view of the disc platform of the apparatus of the present invention.
Figure 3:
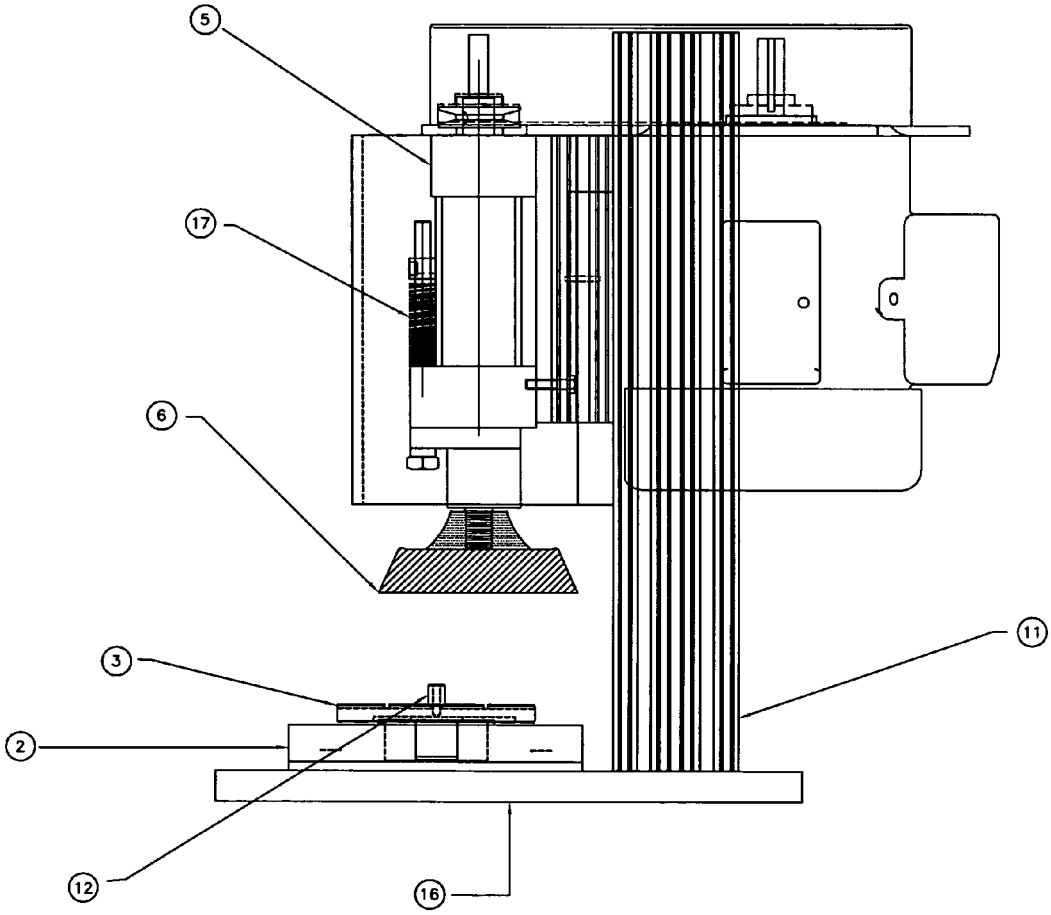
FIG. 3 is a diagram of the side view of the polishing head of the apparatus of the current invention.

During the disc polishing process, a disc to be polished is placed onto the upward facing surface (8) of the disc platform (3). The disc can be placed manually by an operator of the apparatus or an automated means can be used for placing the disc onto the disc platform. FIG. 2 is a side view of the disc platform (3) on the base member (2) of the apparatus.

Figure 4:
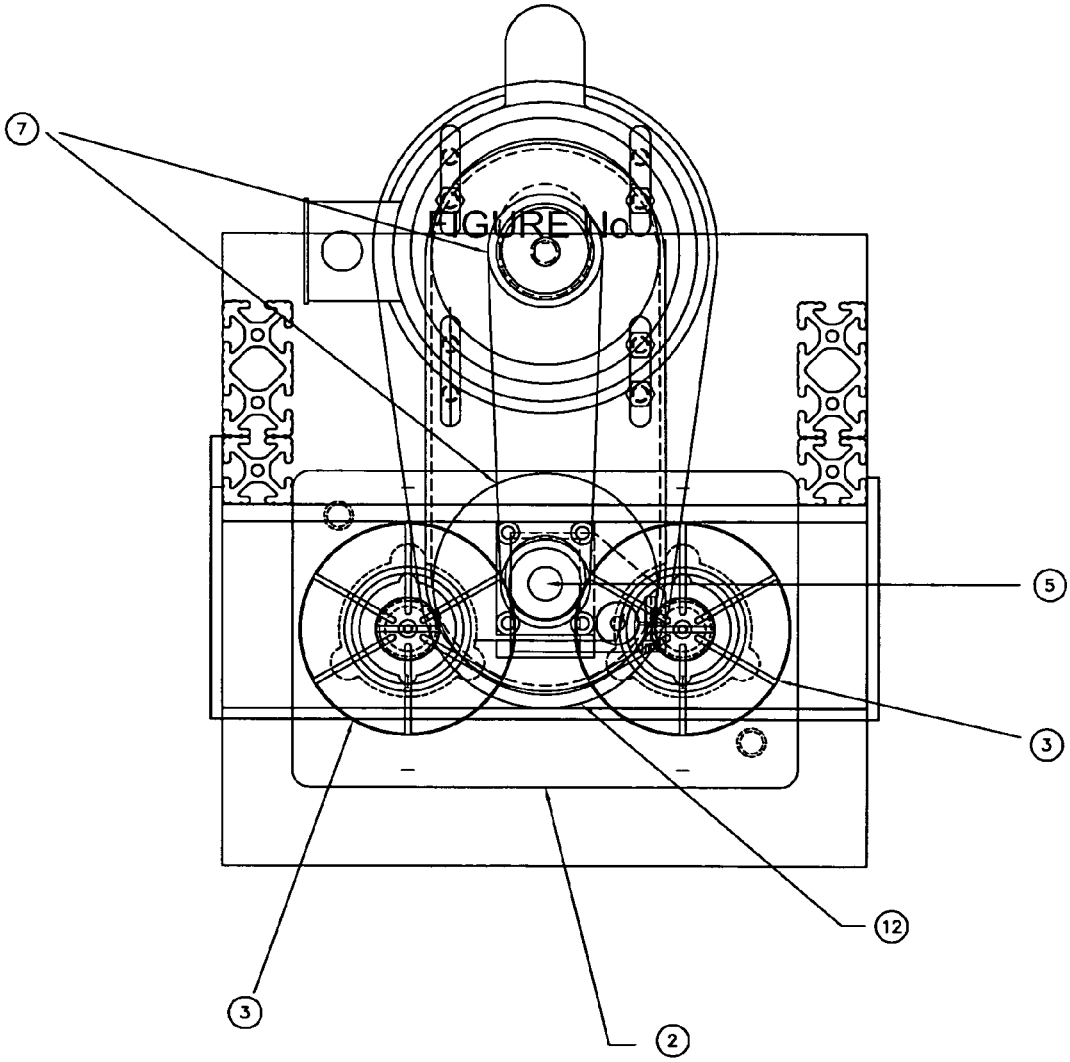
FIG. 4 is an illustrative top view of a preferred embodiment of the apparatus of the present invention showing the relationship between the polishing head and the disc platforms.

In one preferred embodiment of the invention, the apparatus has two rotatable disc platforms (3) positioned side by side on the base member (2) as illustrated in FIG. 4. Optionally, the apparatus may have any number of rotatable disc platforms, as will be further disclosed herein.

The disc platform (3) can be made of any suitable material that is strong enough to withstand the pressure of the polishing head (6) during the polishing process. Preferred materials are selected from the group comprising aluminum, stainless steel, polycarbonate composites and alloys. Preferably, the disc platform (3) is made of a corrosion resistant material. In the preferred embodiment of the invention, the disc platform (3) is made of aluminum.

The disc platform (3) is mounted rotatably on the base member (2) in order to be able to spin upon contact with the rotating polishing head (6) and to relieve frictional stress during the polishing process. In order for the disc platform (3) to rotate, a certain tolerance must be maintained between the base member (2) and the disc platform (3). In the preferred embodiment, the tolerance is in the range of between 0.001 and 0.010 inches. In a more preferred embodiment, the tolerance is in the range of between 0.003 and 0.007 inches.

The disc platform (3) has an upwardly protruding pin (9) in its center to firmly position and hold the disc in the center of the disc platform (3) while the disc is being polished. Optionally, in a preferred embodiment of the apparatus of the invention, the disc platform (3) has a plurality of radial grooves (10) arranged like spokes in the direction positioned from the center to the circumferential outside edge of the disc platform (3), as shown on FIG. 2. The radial grooves (10) serve to hold air between the disc and the disc platform (3), which allows the disc to rotate slightly around the protruding pin (9) on the disc platform (3) thus relieving the frictional stress that may be caused between the disc and the polishing head (6) during the polishing process. The radial grooves (10) also facilitate removal of the disc from the disc platform (3) after the polishing is completed.

A polishing member (5) is connected to the base plate (16) by a support axis (11). The support axis (11) must be sufficiently strong and durable in order to hold the polishing member (5) in place during the polishing process.

The polishing member (5) comprises at least one axially driven rotatable polishing head (6) that is movable between an upper position in which the polishing head is above and out of contact with the upwardly facing surface of the media disc and a lower position in which the polishing head is in contact with the upwardly facing surface of the media disc. The drive (7) moves the polishing head (6) between the upper and lower positions along a path that is perpendicular to the upper surface of the media disc. The polishing head (6) extends downwardly toward the upward facing surface (8) of the disc platform (3) and is positioned at least partly above the disc platform (3) such that the disc platform (3) and the polishing head (6) overlap with one another as illustrated in FIG. 4. During the polishing process of the invention, the polishing head (6) advances downward and comes into contact with the disc media on the disc platform (3).

The polishing head (6) of the present invention has a polishing pad (12) on the downward facing surface of the polishing head (6). FIG. 2 illustrates a side view of the polishing head (6) and the polishing pad (12) of the apparatus of the invention. The polishing pad (12) is made of a suitable material that is capable of buffing scratches from the surface of a disc media.

The polishing head (6) is driven by a precision axial drive means (7) shown in FIG. 1. The axial drive means (7) can be any mechanism or apparatus known in the art for like mechanisms. The axial drive means (7) is further illustrated in FIG. 4. In a preferred embodiment, the axial drive means is an electric drill-like mechanism. Polishing is controlled in a vertical up and down motion much like that.observed in the operation of a drill press. A pneumatic circuit board or sequencer, as commonly known to those skilled in the art, can be used to actuate the axial drive means (7) to a preset position in the vicinity of the disc platform (3). The pneumatic circuit board can advance or retract the polishing head (6) and polishing pad (12) as desired by the operator. After advancing downward toward the surface of the disc media at a preset pressure, the axial drive means (7) rotates the polishing head (6) with the attached polishing pad (12) as is necessary relative to the severity of the scratch on the disc media, so as to remove a desired amount of scratch or material from the surface of the disc media.

Figure 6:
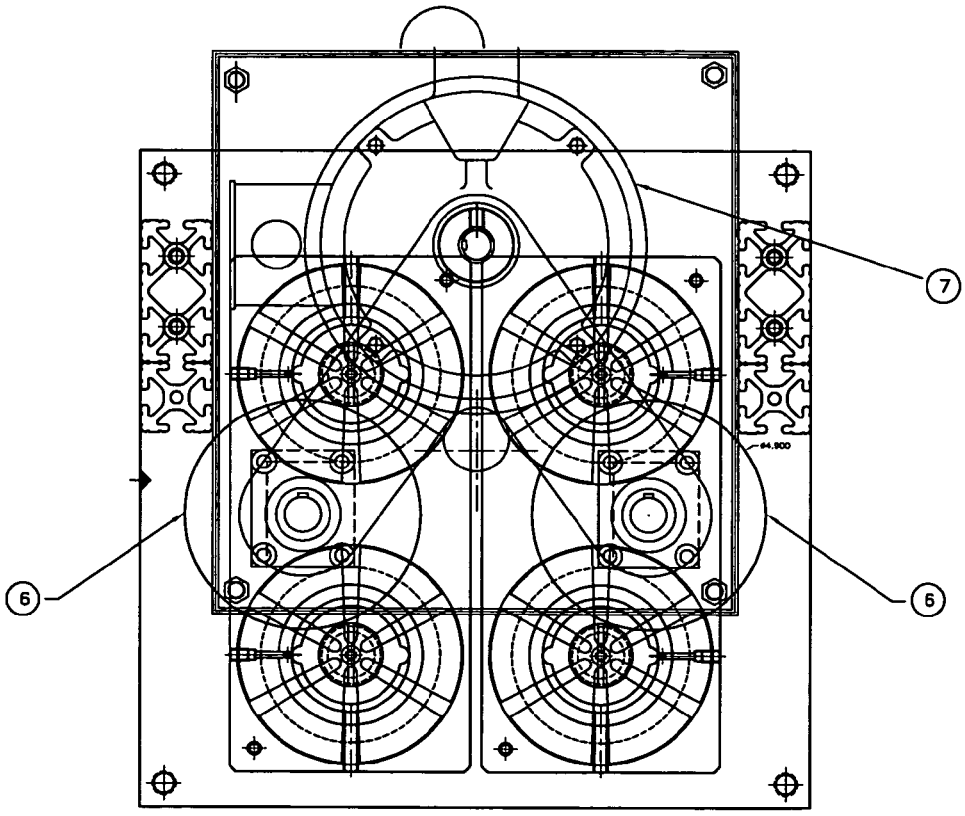
FIG. 6 is a diagram of an alternate embodiment of the apparatus of the present invention, showing two polishing heads and four disc platforms.

In an embodiment of the invention where the apparatus has more than one rotatable disc platform (3) on the base member (2), the polishing head (6) with the polishing pad (12) is positioned in a way that it overlaps at least partially with the surfaces of all the rotatable disc platforms (3). Thus, the more rotatable disc platforms (3), the larger the polishing head (6) is required such that it can contact the surface of each of the rotatable disc platforms (3). In an alternate embodiment, the apparatus of the present invention has three rotatable disc platforms (3). In an alternate embodiment, the apparatus provides for a plurality of polishing heads (6) with polishing pads (12) and rotatable disc platforms (3) to allow for simultaneous polishing of multiple discs. One such embodiment is illustrated in FIG. 6, showing two polishing heads (6) and four rotatable disc platforms (3), which would allow for simultaneous polishing of four discs. The invention may be further expanded using the design parameters of this disclosure to include other combinations of rotatable disc platforms (3) and polishing heads (6) and polishing pads (12) in order to maximize the output capacity of polished discs.

The polishing head (6) of the present invention is a conventional design similar to those used in other industries such as in automobile fender or coach work. It is desirable for the polishing head (6) to have a flexible means that allows some retraction and resiliency when downward pressure is applied onto the disc platform (3). In the preferred embodiment, the polishing head (6) is attached to the axial drive means (7) by a foam center core and comprises a foam body layer. The foam body layer yields slightly when the polishing head (6) and polishing pad (12) comes into contact with the disc to be polished.

The polishing pad (12) is connected to the polishing head (6) by any means commonly known in the art for like mechanisms. Preferred materials for connecting the polishing pad (12) to the polishing head (6) are hook and loop nylon fasteners such as Velcro® of Velcro Industries B.V. but any adhesive or connective materials can be utilized. The hook and loop fasteners are particularly useful because their use allows the operator of the apparatus to easily switch polishing pads (12) as desirable based on the severity of the scratch on the disc media. The material of the polishing pad (12) and the pressure and speed at which the polishing head (6) is operated determine the amount of surface material that will be removed from the surface of the disc media. Thus, deeper scratches will require higher pressure and speed than light scratches. As is commonly known to persons skilled in the art, more abrasive materials are required to remove deeper scratches from a disc media.

According to the apparatus and method of the invention, for removing or reducing scratches from the surface of disc media, the polishing pad (12) is made of an abrasive material necessary for sanding the disc. Preferred materials for the polishing pad (12) of the invention utilized for sanding the disc and removing deep scratches are selected from a group comprising 1,000 to 10,000 grit sand paper. Other preferred abrasive materials are commonly known to those skilled in the art.

According to the apparatus and method of the invention, for rendering a smooth and glossy surface on the disc during polishing, the polishing pad (12) is selected from the group consisting of foam, rubber or any soft composite. In a preferred embodiment, the polishing pad (12) comprises foam composite with a 3,500 grit polishing surface.

According to the method of the invention, a polishing agent is applied to the disc media surface during the polishing process. The polishing agent can be applied by any available means. One embodiment of the invention provides for manual application by simple squeeze or spray bottles. For example, a polishing agent is sprayed directly onto the disc media by the operator before the polishing head (6) comes into contact with the disc media. In an alternate embodiment, the application of the polishing agent can be accomplished through automated means as will be apparent to those skilled in the art. Polishing agents used according to the method of the invention are extensively disclosed in patents and publications and are commonly known to those skilled in the art.

The apparatus of the invention provides for a start and stop mechanism that complies with safety rules and regulations ensuring that the operator's hands are clear of any possible machine movement prior to starting operation of the apparatus.

In a preferred embodiment, the timing of the operation of the apparatus and process can be controlled by a precision timer (13) illustrated in FIG. 1. Preferred polishing time of the method of the invention for obtaining good polishing results is from 1 to 30 seconds of polishing per cycle.

To provide optimum polishing results, a means for automated pressure control is provided to regulate the pressure at which the polishing head (6) with the polishing pad (12) comes into contact with the disc media. This is accomplished by the pressure regulator (14) and counter spring (17) of sufficient force to control the apparatus of the invention, illustrated in FIG. 1. The pressure regulator (14) can be comprised of separate control elements or by a pneumatic circuit board (15). The polishing sequence is best initiated by a two hand unit-tie-down pneumatic control circuit board (15). The pneumatic control circuit board (15) optimizes the spatial constraints of the apparatus, reducing the amount of space necessary for the movement of the polishing member (5) and also increases the functionality or number of polishing cycles that can be performed by the polishing head (6) and polishing pad (12). In such embodiment, the disc polishing pressure regulation is independent from the system pressure. The air pressure is preferably regulated down to a range of between 15 to 100 psi. This separation improves polishing results. A pneumatic pressure filter lubricator control mechanism is used to provide preset movement of the polishing head (6) and pressure in the system.

Figure 5:
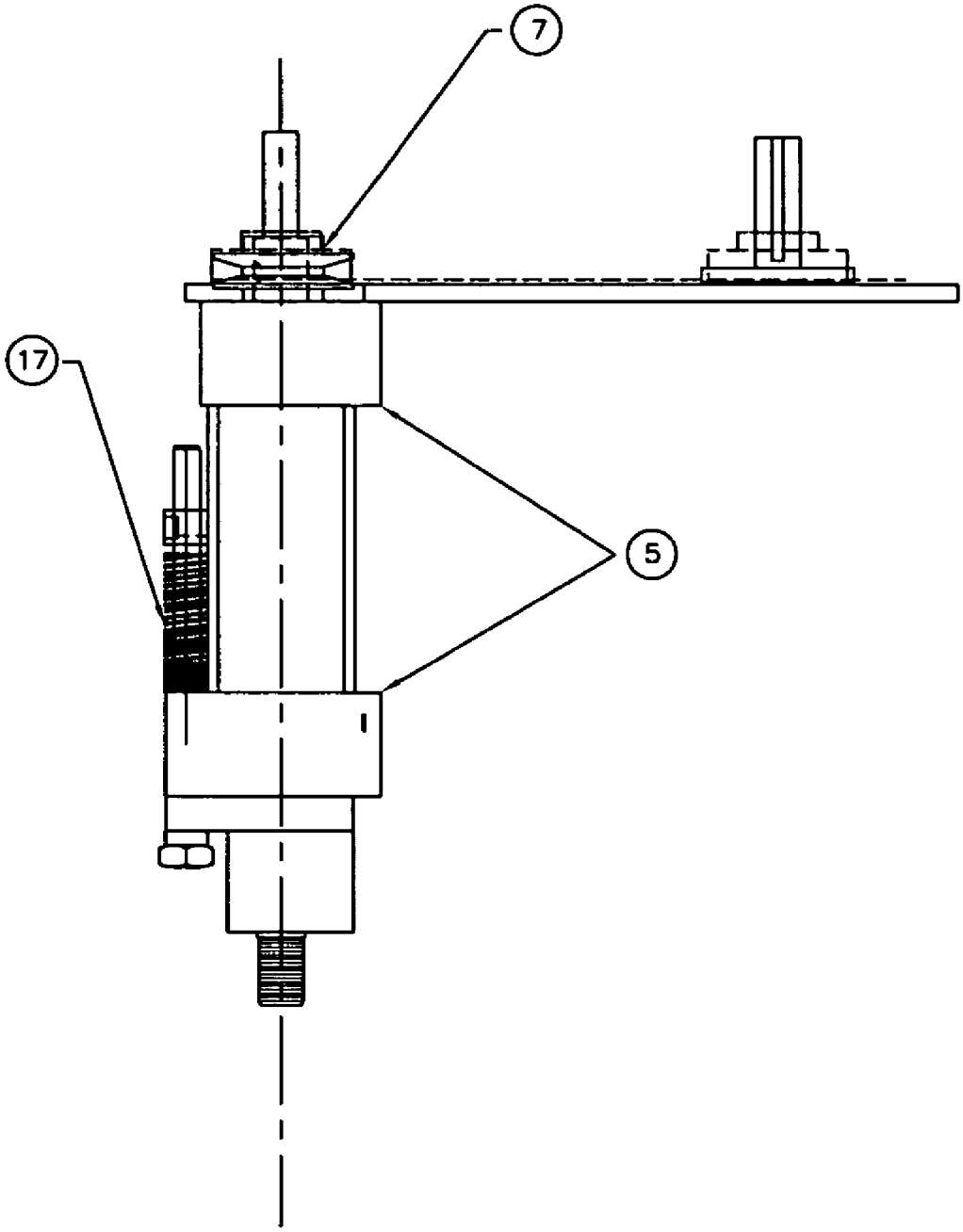
FIG. 5 is a diagram of the axial drive means illustrating the counter-pressure spring of the apparatus of the invention.

For optimal polishing of the disc, it is important to apply consistent pressure and to set controlled tolerances so as to prevent uneven pressure and thus uneven polishing of the disc. The apparatus of the invention provides a counter-pressure spring (17) that is integrated into the axial drive means of the polishing head (10), as illustrated in FIG. 5. The counter-pressure spring (17) is necessary to prevent excess pressure from being applied by the polishing head (10) onto the polishing platform (4). The counter-pressure spring (17) allows retraction of the polishing head (10) relative to the axial drive means to maintain a consistent desirable pressure during the polishing process. The counter-pressure spring (17) solves the problem of varied pressure being applied to the media disc when a human operator or simple mechanical actuation means is used. In the preferred embodiment, desired is a counter-pressure spring that maintains a force of 12 to 15 pounds. The counter-pressure spring (17) also eliminates the need to control the vertical travel distance of the polishing head (10) since the applied force is not a function of the travel distance.

According to the method of the invention, a disc media is polished by using the apparatus disclosed and described herein. The method of the invention can be repeated as many times as required in order to obtain desired results. Each cycle or repetition of the polishing process can be controlled independently or different polishing stations can be established to address differing levels of damage on the discs.

Although the present invention has been described in terms of certain preferred embodiments, other embodiments that are apparent to those of ordinary skill in the art are also intended to be within the scope of the present invention. It should be understood that other uses, variations and advantages of the invention will become known to those upon consideration of the disclosure herein. Such changes, alterations and improvements are meant to be within the scope of the present disclosure. Accordingly, the scope of the present invention is intended to be limited only by the claims appended hereto.

What is claimed is:

1. A device for polishing the surface of a media disc, the device comprising:

a base;

a support extending from the base;

a plurality of rotatable disc platforms located on the base, each rotable disc platform having an upwardly facing surface for holding a media disc to be polished, the media disc having an upwardly facing surface;

a polisher connected to the support at least partially above the disc platform, the polisher comprising a downwardly facing rotatable polishing head and a polishing pad, the polishing pad being fabricated from an abrasive material for polishing the surface of the media disc and being carried by the polishing head, the polishing head being movable between an upper position in which the polishing pad is above and out of contact with the upwardly facing surface of the media disc and a lower position in which the polishing pad is in contact with the upwardly facing surface of the media disc, the polishing head being in contact with the upwardly facing surface of the media discs on at least two of the rotatable disc platforms when the polishing head is in the lower position; and a driver for moving the polishing head between the upper and lower positions along a path that is perpendicular to the upper surface of the media disc.

2. The polishing device according to claim 1 further comprising:

a controller for automatically regulating the pressure that the polishing head applies to the upper surface of the media disc.

3. The polishing device according to claim 2 wherein the pressure regulating controller further comprises a counter-spring for limiting the amount of pressure that the polishing head applies to the media disc.

4. The polishing device according to claim 3 wherein the automatic pressure regulator is a pneumatic controller.

5. A device for polishing the surface of a media disc, the device comprising:

a base;

a support extending from the base;

a rotatable disc platform located on the base, the rotable disc platform having an upwardly facing surface for holding a media disc to be polished, the media disc havin an upwardly facing surface, the rotatable disc platform comprising a centrally located cylindrical pin center for centrally positioning the media disc on the upward facing surface of the rotatable disc platform and a plurality of radial grooves formed in the upward facing surface of the rotatable disc platform which, together with the pin, serve to rotate relative to the rotatable disc platform on a cushion of air;

a polisher connected to the support at least partially above the disc platform, the polisher comprising a downwardly facing rotatable polishing head and a polishing pad, the polishing pad being fabricated from an abrasive material for polishing the surface of the media disc and being carried by the polishing head, the polishing head being movable between an upper position in which the polishing pad is above and out of contact with the upwardly facin surface of the media disc and a lower position in which the polishing pad is in contact with the upwardly facing surface of the media disc; and a driver for moving the polishing head between the upper and lower positions along a path that is perpendicular to the upper surface of the media disc.

6. A device for polishing the surface of a media disc, the device comprising:

a base;

a support extending from the base;

a rotatable disc platform located on the base, the rotable disc platform having an upwardly facing surface for holding a media disc to be polished, the media disc having an upwardly facing surface, the rotatable disc platform comprising a centrally located cylindrical pin center for centrally positioning the media disc on the upward facing surface of the rotatable disc platform and a plurality of radial grooves formed in the upward facing surface of the rotatable disc platform which, together with the pin, serve to rotate relative to the rotatable disc platform on a cushion of air;

a polisher connected to the support at least partially above the disc platform, the polisher comprising a downwardly facing rotatable polishing head and a polishing pad, the polishing pad being fabricated from an abrasive material for polishing the surface of the media disc and being carried by the polishing head, the polishing head being movable between an upper position in which the polishing pad is above and out of contact with the upwardly facing surface of the media disc and a lower position in which the polishing pad is in contact with the upwardly facing surface of the media disc; and a driver for moving the polishing head between the upper and lower positions along a path that is perpendicular to the upper surface of the media disc; and a controller for automatically regulating the pressure that the polishing head applies to the upper surface of the media disc.

7. The polishing device according to claim 6 wherein the pressure regulating controller further comprises a counter-spring for limiting the amount of pressure that the polishing head applies to the media disc.

8. The polishing device according to claim 7 wherein the rotatable disc platform comprises a plurality of disc platforms, the polishing head being in contact with the upwardly facing surface of the media discs in at least two of the rotatable disc platforms when the polishing head is in the lower position.

* * * * *